US011565536B2

(12) United States Patent
Bernard et al.

(10) Patent No.: US 11,565,536 B2
(45) Date of Patent: Jan. 31, 2023

(54) ENVELOPE PRINTING DEVICE

(71) Applicant: QUADIENT TECHNOLOGIES FRANCE, Bagneux (FR)

(72) Inventors: Dominique Bernard, Massy (FR); Francis Coret, Gournay sur Marne (FR); Stephane Le Gallo, Morangis (FR)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 147 days.

(21) Appl. No.: 17/149,961

(22) Filed: Jan. 15, 2021

(65) Prior Publication Data

US 2021/0229471 A1 Jul. 29, 2021

(30) Foreign Application Priority Data

Jan. 29, 2020 (EP) ..... 20 305 078

(51) Int. Cl.
*B41J 29/38* (2006.01)
*B41J 11/42* (2006.01)

(52) U.S. Cl.
CPC ..... *B41J 11/42* (2013.01)

(58) Field of Classification Search
CPC ..... G07B 17/005; G07B 17/006; G07B 2017/005
See application file for complete search history.

(56) References Cited

U.S. PATENT DOCUMENTS 4,821,049 A * 4/1989 Eckl ..... G07B 17/00467 271/274
6,168,333 B1 1/2001 Merz et al.
8,123,023 B2 2/2012 Williams et al.
(Continued)

FOREIGN PATENT DOCUMENTS

| | | |
|---|---|---|
| EP | 1431925 A2 | 6/2004 |
| EP | 1431925 A3 | 6/2006 |
| WO | 0162506 A1 | 8/2001 |

OTHER PUBLICATIONS

European Search Report for EP 20 30 5078, dated Jul. 3, 2020, 2 pages.

*Primary Examiner* — Lam S Nguyen
(74) *Attorney, Agent, or Firm* — Cozen O'Connor

(57) ABSTRACT

A device for printing information at multiple predetermined positions of a flat object including a registration wall, a print module including print nozzles and a print plate and displaceable along an horizontal axis perpendicular to the registration wall, fixed upper drive members for moving the flat object in a direction of transport along the registration wall, the print plate and the fixed upper drive members together forming an upper reference in a vertical direction, and lower pressing members for pressing the flat object against the upper reference, the device further comprises at least one mobile upper drive member and, for avoiding contact with the flat object immediately after printing, the at least one mobile upper drive member is vertically mobile and configured to be moved from a lower to an upper position above the upper reference when the displaceable print module is positioned along the horizontal axis ahead of the at least one mobile upper drive member in the direction of transport.

20 Claims, 5 Drawing Sheets

(56) References Cited

U.S. PATENT DOCUMENTS

| | | | | |
|---|---|---|---|---|
| 2007/0134043 | A1* | 6/2007 | Henson | G07B 17/00508 400/586 |
| 2007/0208675 | A1* | 9/2007 | Desire | B41J 11/20 705/408 |
| 2010/0091346 | A1* | 4/2010 | Audeon | G07B 17/00467 358/498 |
| 2010/0219041 | A1 | 9/2010 | Williams et al. | |
| 2013/0127968 | A1 | 5/2013 | Lyga et al. | |

* cited by examiner

ENVELOPE PRINTING DEVICE

TECHNICAL FIELD

The present invention relates to mail processing machines, and notably to an envelope printer to be used in combination with mail inserters.

BACKGROUND

Despite a noticeable decrease in printed correspondence since the advent of Internet, physical mail remains a preferred and efficient communication channel for many customer segments. Letters have undoubtedly more substance than emails and a higher propensity to capture and retain customer attention. Modern output management technology allows the generation of highly personalized documents, and various messages may be printed at multiple positions on envelopes where these documents have been inserted, in addition to the sender or delivery address.

Inserters can be operated in several modes. In the simplest one, job parameters are fixed and the same tasks are performed on all mailpieces of a same batch. In a more elaborated mode, corresponding to an open loop production system, each mailpiece bears control codes that are read and interpreted by the inserter (e.g. for adding more pages or inserts). In the most sophisticated (data driven) mode, corresponding to a close loop production system, the mailpiece bears a unique identifier that points to a database where the finishing instructions for that particular mailpiece are recorded.

In a close loop production system, the production software generates a job file that contains finishing instructions about each mailpiece that are (to be) printed. As mailpieces enter a processing equipment such as a folder/inserter, their identifiers are scanned, finishing instructions are looked-up in the job file and executed. Finishing instructions are typically related to inserts to be added into envelopes, and addresses or messages to be printed thereon, thus avoiding the use of window envelopes.

Printing of recipient addresses requires an address printer, otherwise known as an envelope printer, to be located at the exit of the inserter. An envelope printer may also be operated independently, with addresses taken from a mailing list. This is the case notably when the content of mailpieces is not personalized. However, in many applications, the content of mailpieces will be personalized. Synchronisation and real-time communication between the inserter and the envelope printer is required to ensure a perfect match between documents, inserts and envelopes to form the complete mailpieces that are sent to customers.

Personalized mailpiece content means that envelope thickness may vary from one mailpiece to another, and moreover between successive batches of mail, whereas the position at which the address is to be printed onto the envelope, may vary as well. The position of addresses are notably defined by the Universal Postal Union (UPU) S19 standards, along with reserved areas for encoding of ID-tags and routing information, for applying postmarks, indicia and service endorsements, and for printing addresses, advertising or other information.

Franking machines are designed for printing in the area M1 located at the top right corner of mailpieces, according to UPU requirements. For large batches of typically tens of thousands of mailpieces, a permit mark may be printed instead of a franking mark. A franking machine may also be used to print sender/return addresses, slogan and/or promotional messages, in the area M1W including the area M1 and extending across the whole width of the mailpiece.

Other devices, such as the RENA XPS-80 or XPS-90, are designed specifically to print addresses, text and graphical elements onto individual or mass-mailed items in professional applications requiring high throughput. These devices include two print units, each one having three ink jet cartridges, which can be adjusted manually (on XPS-80) or automatically (on XPS-90) to print at multiple positions on envelopes of different sizes. The mailpieces are horizontally driven by transport belts and the print spacing must be adjusted manually. It is indeed necessary to ensure a fixed distance between the nozzle plate of the ink jet print cartridges and the upper surface of the envelopes for optimal print quality. Pinwheels are disposed to prevent this upper surface from touching the nozzle plates and avoid ink smearing. These devices are designed for printing on mailpieces of consistent thickness within a batch, and the print spacing must be adjusted for each batch.

More sophisticated devices are designed to print over a larger portion of mailpieces. For instance, U.S. Pat. No. 8,123,023 describes a conveyance system for printing on mailpieces, while being registered against a registration plate. The system comprises a vacuum belt to transport mailpieces along the feed path, and a spring biasing device operative to bias the conveyor belt toward the contact surface of the registration plate. The system operates with a bank of printheads arranged in a staggered or stepped array. The registration plate includes runners which define channels within registration plate openings. The runners contact the surface of mailpieces at a position between nozzles and do not interfere with ink deposited in linear zones to each side of a runner. Such zones may correspond to the white space between printed lines of a destination or return address.

Though the system of U.S. Pat. No. 8,123,023 is relatively complex, it only accommodates up to about one-half ½ inches of envelope thickness, and it doesn't allow to print at positions where the runners contact the mailpieces. Moreover, it is usually not required to print over a large portion of a mailpiece, but rather in the area M1W and, for addresses, in a portion of about two inches, that may be located anywhere in the address area defined by UPU standards. The sender may also wish to print pictures, advertising and/or other messages at any position outside these areas, provided that they do not interfere with the various marks applied for postal distribution.

It is therefore a need to provide an envelope printer of relatively simple construction, capable of transporting mailpieces of variable thickness and printing at multiple positions thereon. Such envelope printer shall ensure an accurate registration of mailpieces while operating at high speed and shall avoid ink smearing on freshly printed envelopes.

Object and Definition of the Invention

It is an object of the invention to provide an envelope printer for processing large mail batches, and specifically for printing addresses, slogan and/or promotional messages as well as permit marks, at multiple positions on envelopes of variable size and thickness.

It is another object of the invention to provide an envelope printer ensuring accurate registration of mailpieces at said multiple print positions and avoiding ink smearing, while being capable of printing at high speed.

It is another object of the invention to provide an envelope printer of relatively simple construction, and flexible enough to allow rapid set up changes from one batch to another.

The envelope printer of the invention can be operated in combination with an inserter or independently.

These objects are achieved by a device for printing information at multiple predetermined positions of a flat object including a registration wall, a print module including print nozzles and a print plate and displaceable along an horizontal axis perpendicular to the registration wall, fixed upper drive members for moving the flat object in a direction of transport along the registration wall, the print plate and the fixed upper drive members together forming an upper reference in a vertical direction, and lower pressing members for pressing the flat object against said upper reference, characterized in that it further comprises at least one mobile upper drive member and in that, for avoiding contact with the flat object immediately after printing, said at least one mobile upper drive members is vertically mobile and configured to be moved from a lower to an upper position above said upper reference when said displaceable print module is positioned along said horizontal axis ahead of said at least one mobile upper drive member in the direction of transport.

Preferably, the device further comprises a fixed print module at a fixed location respective to the registration wall and cooperating with the fixed upper drive members and the lower pressing members for printing at a fixed position on the flat object while said flat object is moving in the direction of transport.

According to an embodiment, the fixed upper drive members comprise a group of fixed upper drive rollers located upstream the displaceable print module and when present the fixed print module in the direction of transport.

According to an embodiment, the fixed upper drive members comprise a group of fixed upper drive rollers located downstream the displaceable print module and when present the fixed print module in the direction of transport.

According to an embodiment, the lower pressing members comprise lower pressing rollers cooperating with the fixed and mobile upper drive rollers and a pressing plate perpendicular to the reference wall and traversing the device for pressing the flat object against the printing plate.

According to an embodiment, the device comprises at least two mobile upper drive rollers which are driven by a common drive axis and drive belt. And, the common drive axis also drives the fixed upper drive rollers located downstream the displaceable print module and when present the fixed print module in the direction of transport.

According to an embodiment, the device further comprises at least two cams acting against spring biased levers for moving the at least two mobile upper drive rollers between the lower and the upper position. The first and second cams are opposite and can rotate along a same horizontal axis so that when one of the at least two mobile upper drive rollers is in the upper position, the other one is in the lower position.

According to an embodiment, the mobile upper drive rollers can be moved independently from each other between the lower and the upper position.

According to an embodiment, a mobile upper drive roller is moved from the lower to the upper position by a linear cam attached to the displaceable print module when said displaceable print module is positioned along the horizontal axis ahead of said mobile upper drive roller in the direction of transport.

According to an embodiment, the at least one mobile upper drive members comprises three mobile upper drive rollers and three cams configured around a same horizontal axis in such a manner that two of the three mobile upper drive rollers are in the lower position while the third one is in the upper position.

According to an embodiment, the print modules can comprise one, two, three or four inkjet printheads.

According to an embodiment, the device comprises a spitting reservoir and the print plate comprises elongated slots through which ink of the inkjet printheads can be jetted in the spitting reservoir.

According to an embodiment, the flat object is an envelope of the C-series, the B-series or DL sizes according to ISO 269 terminology.

BRIEF DESCRIPTION OF THE DRAWINGS

The invention will be described and explained with additional specificity and detail through the use of the accompanying drawings in which.

DETAILED DESCRIPTION OF EXEMPLARY EMBODIMENTS

Figure 1:
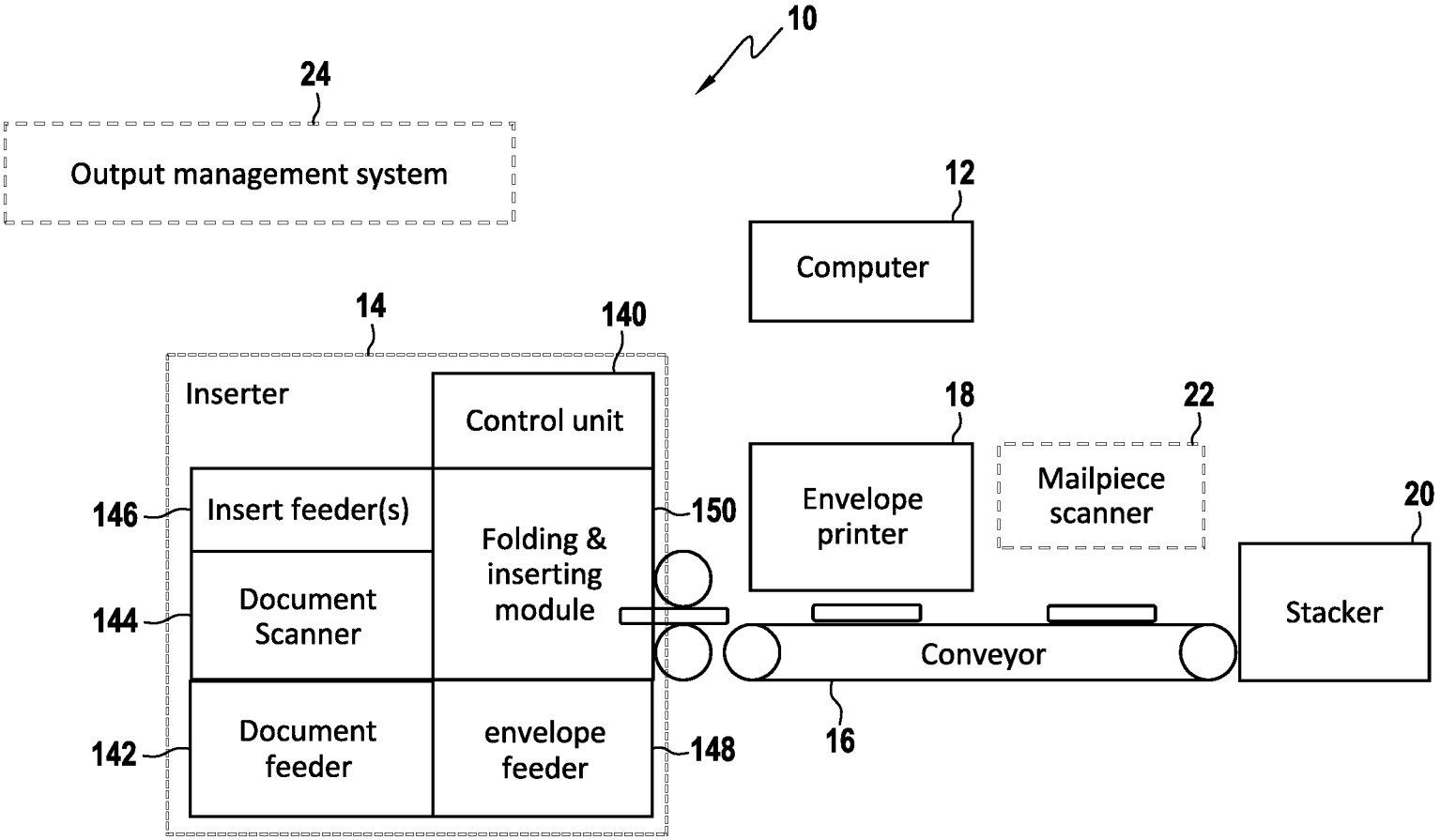
FIG. 1 is a general view of a mail production system showing the various components and their interactions during the production process.

FIG. 1 is a general view of a mail production system 10 showing the various components and their interactions during the production process. The system comprises a general purpose computer 12, an inserter 14, a conveyor 16, an envelope printer 18, a stacker 20, and optionally a mailpiece scanner 22. The inserter 14 comprises a control unit 140 (e.g., processor, memory), a document feeder 142, a document scanner 144, one or more insert feeders 146, an envelope feeder 148 and a folding & inserting module 150.

The computer 12 is usually in relation with an external output management system 24, from which job data are imported. The production software generates a job file that contains finishing instructions about each mailpiece. Job reports and statistics are generated by the computer 12 and sent to the output management system 24 for consolidation with other data.

In operation, documents are extracted from the document feeder 142. Each document bears an identifier which is captured by the document scanner 144. Finishing instructions pertaining to that document are looked-up in the job file and executed. Finishing instructions are typically related to inserts to be added into envelopes, and addresses or messages to be printed thereon. Inserts are extracted from the insert feeder 146 to be collated with the document and the whole set is directed to the folding & inserting module 150.

Envelopes are extracted from the envelope feeder 148 and directed to the folding & inserting module 150. These envelopes are preferably plain windowless envelopes on which the recipient address will be printed. The sets are inserted into envelopes to form complete mailpieces. The mailpieces exit from the folding & inserting module 150 and are conveyed to the envelope printer 18, where addresses or other messages included in the job file are printed. For large batches of typically tens of thousands of mailpieces, permit marks may also be printed.

Synchronisation and real-time communication between the inserter 14 and the envelope printer 18 is required to ensure a perfect match between documents, inserts and envelopes to form the complete mailpieces that are sent to customers. Optionally, the mailpieces may be scanned by a mailpiece scanner 22 before being stacked in the stacker 20. This second scanning operation is usually not required for integrity purposes, as this is rather ensured by monitoring and recording of the perfect execution of finishing instructions. However, it might be required to register images of the mailpieces, for instance to prove that a particular mailpiece has been processed.

Figure 2:
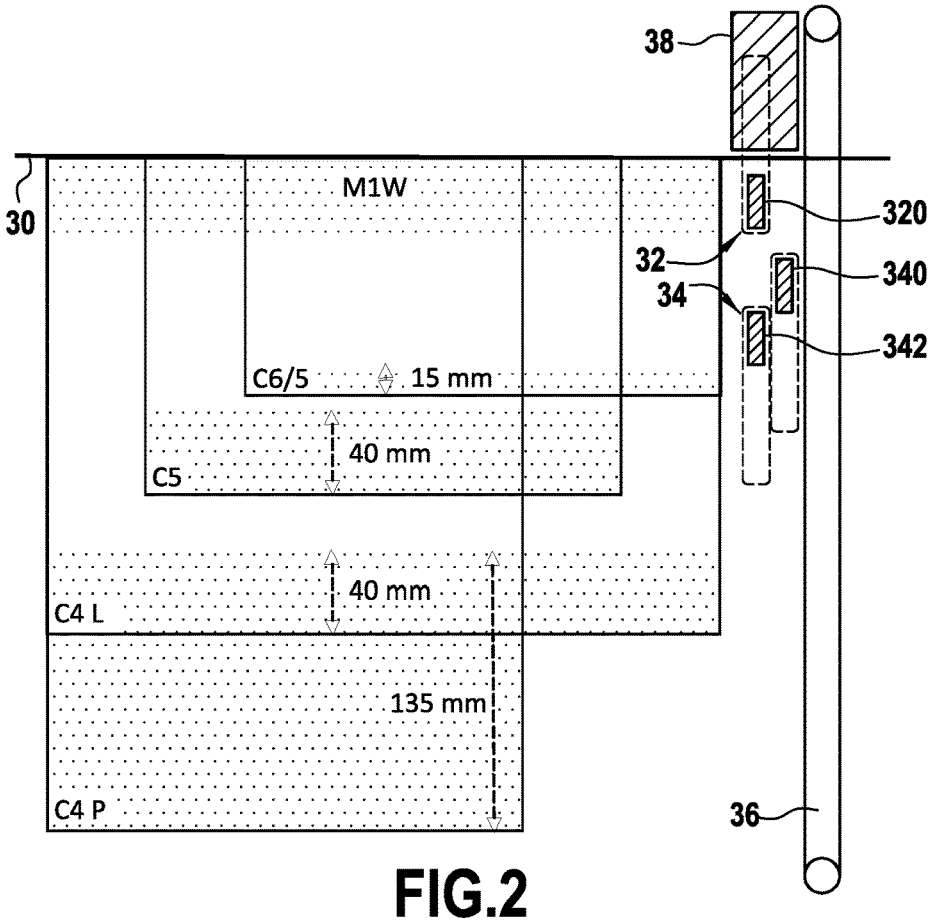
FIG. 2 is a view showing standard size envelopes with printable and reserved areas.

FIG. 2 is a view showing standard size envelopes with printable and reserved areas. The area M1W is common to all envelope sizes and extends till 40 mm from the top edge of the envelope. While being transported through the envelope printer 18, the envelopes will abut against a first reference wall 30 to make sure that their top edge is at a consistent position.

UPU S19 standards defines areas on postal items which may be used for the printing or encoding of information needed to support postal processing. Specific areas are defined for encoding of ID-tags and routing information, for applying postmarks, indicia and service endorsements, and for printing addresses, advertising or other information. In particular, the delivery address should be positioned entirely within the address zones defined for various envelope sizes by UPU S19d standard. Sender/return addresses, slogan and/or promotional messages may be printed in the area M1W, including the area M1 reserved for franking marks and prolonging it to the left. A permit mark may also be printed in the area M1 instead of a franking mark.

Large mailpieces may be printed in landscape or portrait mode. In the last case; the delivery address is printed following the direction of the smallest dimension of the envelope. Delivery addresses shall not be printed in an area high of 135 mm from the bottom of the envelope. However, advertising and promotional messages may be printed or pre-printed in this area.

A band of 15 mm high is represented at the bottom of the C6/5 envelope, a band of 40 mm is represented at the bottom of the C5 and C4 envelope in landscape mode, and a band of 135 mm is represented at the bottom of the C4 envelope in portrait mode. For a given envelope size, delivery addresses may be printed in the space left between these bands and the M1W area, except in 15 mm wide strips (not represented) next to the right and left sides of the envelopes. The sender may also wish to print pictures, advertising and/or other messages at any position outside these areas, provided that they do not interfere with the various marks applied for postal distribution.

According to the invention, the envelope printer 18 shall be able to print in the area M1W and at any position on the envelope, in the reserved areas for addresses and outside these reserved areas for pictures, advertising and/or other messages. Typically a first print module 32 will be used for printing permit marks, sender address, slogans and/or messages in the area M1W, and a second print module 34 will be used to print delivery addresses, advertising or other information in and beyond the address area. For convenience, the nozzle plates 320; 340, 342 of the print modules have been represented at their respective print positions. The print position of the first print module 32 is fixed respective to the reference wall 30 while the second print module 34 is displaceable along an horizontal axis perpendicular to the reference wall 30 by a linear drive 36, in order to print at multiple positions, depending of envelope size and job requirements. The same linear drive 36 can move the second 34 (and optionally the first 32) print module to a service station 38. In a simpler embodiment, only the second print module 34 may be provided and displaceable to print in the area M1W and in the other positions where information need to be printed.

Like in franking machines, a plurality of drive members such as rollers or conveyor belts, may be used for conveying mailpieces along a transport path. The mailpieces will be pressed against a plate forming an upper reference in the vertical direction. It is indeed necessary to reference the front side of the mailpieces with respect to the print modules to ensure a consistent print distance of around one millimetre.

Immediately after printing, the printed area shall not be touched by rollers or other elements, otherwise smearing may occur. On the other hand, it is necessary to drive the mailpiece by its top and/or bottom edges to ensure a good registration against the first reference wall. However the bottom edge of a C6/5 or a C5 envelope is located in the middle of the address area of a C5 or respectively a C4 envelope. Depending on where the second print module is positioned, its might be necessary to retract the driving means at the bottom of C6/5 or C5 envelopes.

Figure 3:
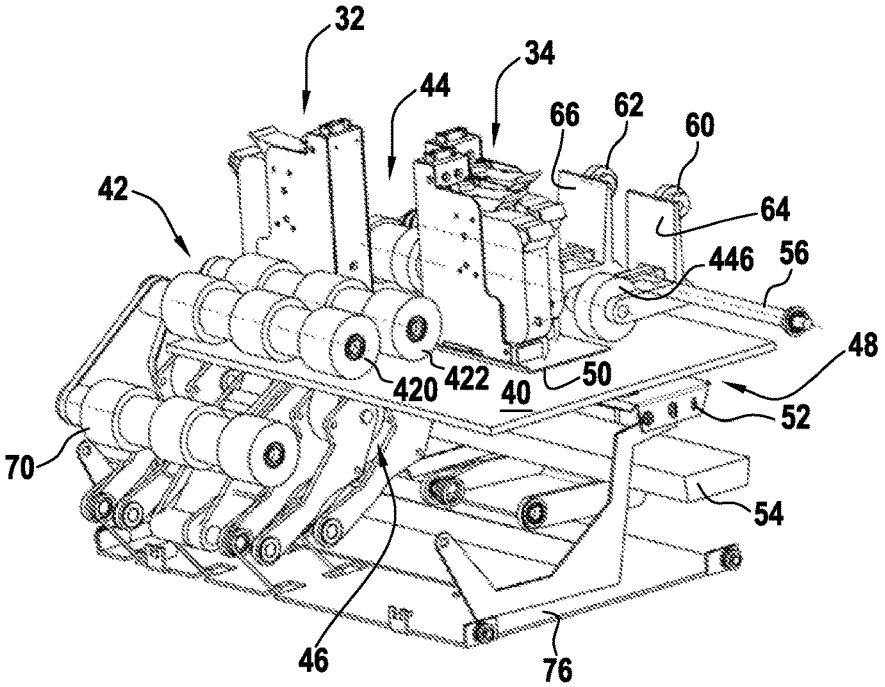
FIG. 3 is a perspective view of an envelope printer according to the invention.

FIG. 3 is a perspective view of an envelope printer according to the invention.

The first 32 print module is represented in its fixed printing position. The second 34 print module is represented at a position corresponding to the middle of the C4 envelope here in portrait mode. The envelope 40 is transported by two groups of fixed upper drive members, an upstream group 42 and a downstream group 44 in the direction of transport. Lower pressing members, also divided in two groups, an upstream group 46 and a downstream group 48, ensure that the envelope is pressed against the respective fixed upper member groups.

Both print modules comprise a print plate 50 having an opening 500 (which can be seen on FIG. 7) located around the print nozzles in the direction of transport. The print plate 50 and the fixed upper drive members 42, 44 together form an upper reference in the vertical direction. The envelope 40 is pressed against the print plate 50 by a pressing plate 52 perpendicular to the reference wall 30 and traversing the device to ensure a consistent print distance of around one millimetre. The pressing plate 52 has two elongated slots 520, 522 (which can be seen on FIG. 4) through which ink can be jetted into a spitting reservoir 54, in order to keep nozzles wet if the print modules are left stationary without printing for a period of time, after which the print modules may be brought back to the service station 38.

The downstream group 44 of fixed upper drive members include fixed rollers 440, 442 aligned with the first print module 32 and having a recess 440A, 442A in the area M1W where sender/return addresses, slogan and/or promotional messages may be printed. These fixed upper drive rollers cooperate with lower pressing rollers 480 for printing at a fixed position on the envelope 40 while it is moving in the direction of transport.

The second 34 print module is displaceable along the horizontal axis in order to reach any print position below the area M1W and the bottom of the envelope. This print position is predetermined amongst the job parameters for a given batch of mailpieces and remains fixed for the duration of the batch. When the batch is completed, the second 34 print module can be displaced to any other print position according to the job parameters of the next batch.

The envelope 40 is also driven by a pair of vertically mobile upper drive rollers 444, 446. These mobile upper drive rollers are driven by a common drive axis 56 and drive belts 58. In a preferred embodiment, the common drive axis 56 also drives the fixed upper drive rollers 440, 442 of the downstream group 44.

In order to avoid contact with the envelope immediately after printing, the vertically mobile upper drive rollers 444, 446 are configured to be moved by a pair of cams 60, 62 acting on a pair of levers 64, 66 from a lower to an upper position above the upper reference when the second 34 print module is positioned along the horizontal axis ahead of one of the mobile upper drive rollers 444, 446 in the direction of transport.

Springs, not represented, urge the levers 64, 66 against the cams 60, 62 so that the rollers will move upward when the cams are retracted. In the preferred embodiment, the cams 60, 62 are opposite and rotate along a same horizontal axis 68 so that when one of the mobile upper drive rollers is in the upper position, the other one is in the lower position. This is to ensure that at least one of the mobile upper drive rollers 444, 446 will always be in the lower position, so that the envelope 40 is pressed against it by the lower pressing rollers of the downstream group 48.

Entry rollers 70 are located upstream in the direction of transport to engage the envelopes into the envelope printer. In the preferred embodiment, these entry rollers 70 and the fixed upper drive rollers 420, 422 of the upstream group 42 are driven by a common drive belt 72. Another drive belt 74, illustrated on FIG. 4, extends between the fixed upper drive rollers 422, 440 of the upstream and downstream groups. All the components described above are mounted on a chassis 76 partially represented here. Others components such as drive motors and other drive belts are not represented.

Figure 4:
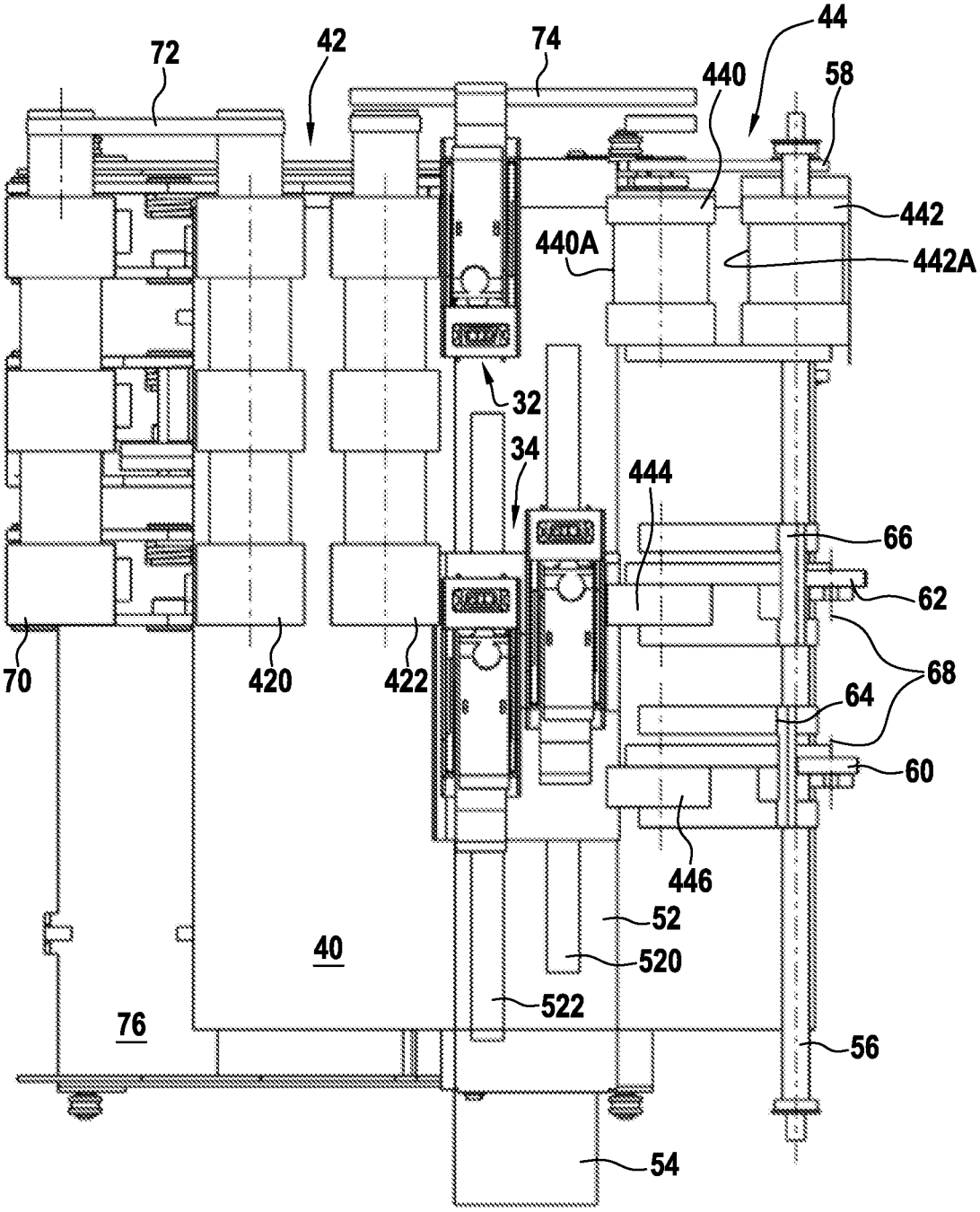
FIG. 4 is a top view of the envelope printer according to the invention.

FIG. 4 is a top view of the envelope printer according to the invention,

In the example illustrated, the second 34 print module is represented at a position corresponding to the middle of the C4 envelope here in portrait mode. The first 444, closest to the reference wall 30, mobile upper drive roller is in its upper position in order to avoid contact with the envelope immediately after printing, while the second 446, further away from the reference wall 30, mobile upper drive roller is in its lower position and thus drives the envelope 40 together with the fixed upper drive rollers 440, 442. This is achieved by the rotation of the opposite cams 60, 62.

If the second 34 print module needs to print in a position corresponding to the bottom of a C4 envelope in landscape mode, then the position of the cams 60, 62 will be inverted and the first mobile upper drive roller 444 will be in its lower position and drive the envelope, while the second mobile upper drive roller 446 will be in its upper position, in order to avoid contact with the envelope immediately after printing. If the second 34 print module needs to print further away from the reference wall 30, then then the position of the cams 60, 62 can be inverted again, so that the envelope 40 is driven by the second mobile upper drive roller 446.

Figure 5:
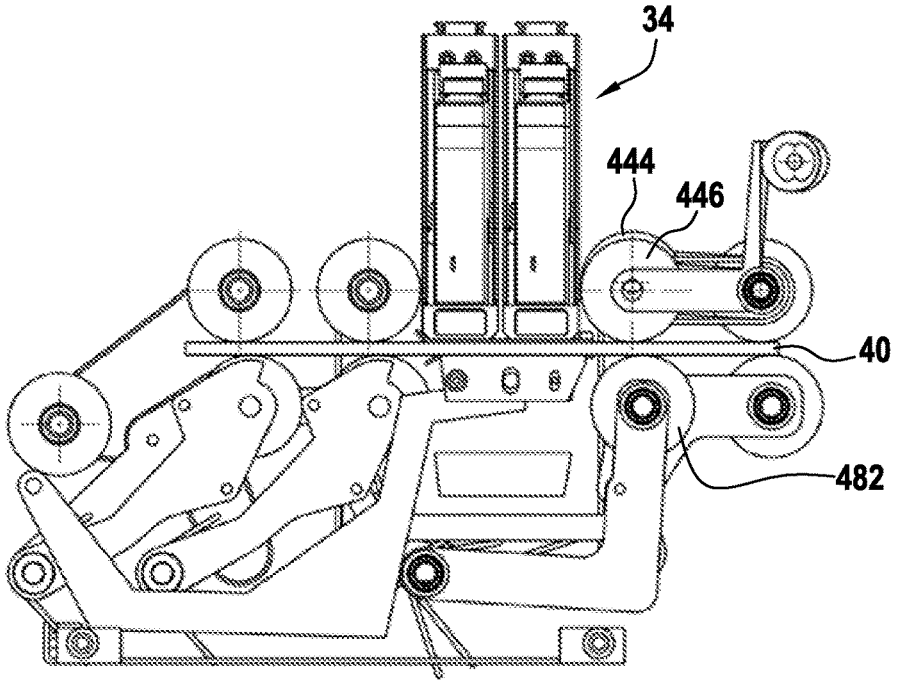
FIG. 5 is a front view of the envelope printer according to the invention.

FIG. 5 is a front view of the envelope printer according to the invention.

Like in FIGS. 3 and 4, the second 34 print module is at a position corresponding to the middle of the C4 envelope in portrait mode. The second mobile upper drive roller 446 is in its lower position and cooperates with the lower pressing rollers 482 of the downstream group 48 to drive the envelope 40. The first mobile upper drive roller 444 is in its upper position in order to avoid contact with the envelope immediately after printing.

Figure 6:
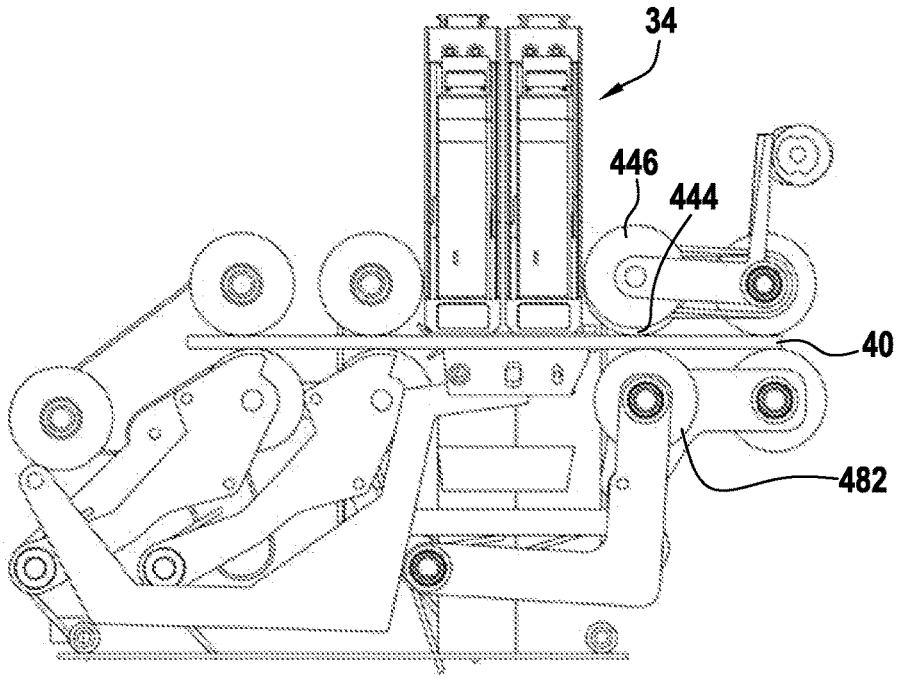
FIG. 6 is another front view of the envelope printer according to the invention.

FIG. 6 is another front view of the envelope printer according to the invention.

Unlike in FIGS. 3 and 4, the second 34 print module is now at a position corresponding to the bottom of a C4 envelope in landscape mode. The first mobile upper drive roller 444 is in its lower position and cooperates with the lower pressing rollers 482 of the downstream group 48 to drive the envelope 40. The second mobile upper drive roller 446 is in its upper position in order to avoid contact with the envelope immediately after printing.

Thanks to these mobile upper drive rollers, the envelope printer of the invention is capable of printing addresses, slogan and/or promotional messages as well as permit marks, at multiple positions on envelopes of variable thickness, while avoiding smearing of freshly printed areas and allowing rapid set up changes from one batch of mailpieces to another.

Figure 7:
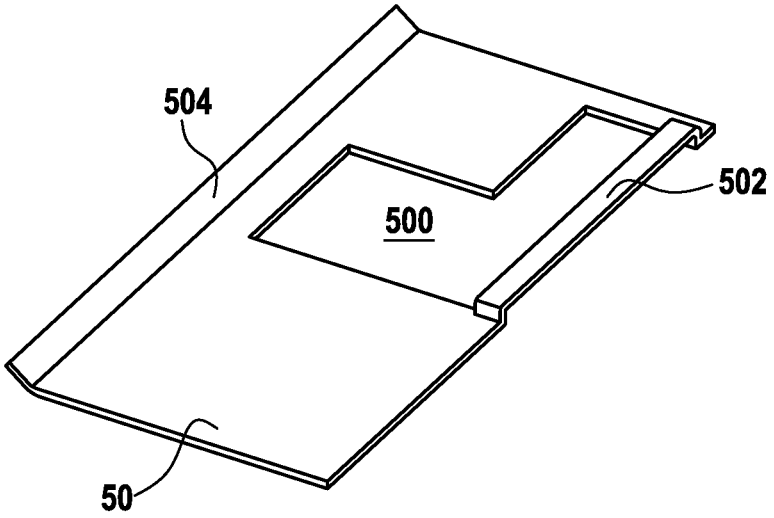
FIG. 7 is a view of a print plate of the envelope printer of the invention.

FIG. 7 is a view of the print plate of the envelope printer of the invention.

The print plate 50 represented here is the one of the second 34 print module. An opening 500 surrounding the nozzles plates (not represented) is formed in the print plate, followed in the direction of transport by an elevated portion 502, in order to avoid touching the printed area immediately after printing. The print plate 50 is preferably a piece of stainless steel having an angled side 504 to ease the introduction of envelopes.

A similar opening followed in the direction of transport by an elevated portion is formed in the print plate of the first print module (not represented).

Figure 8:
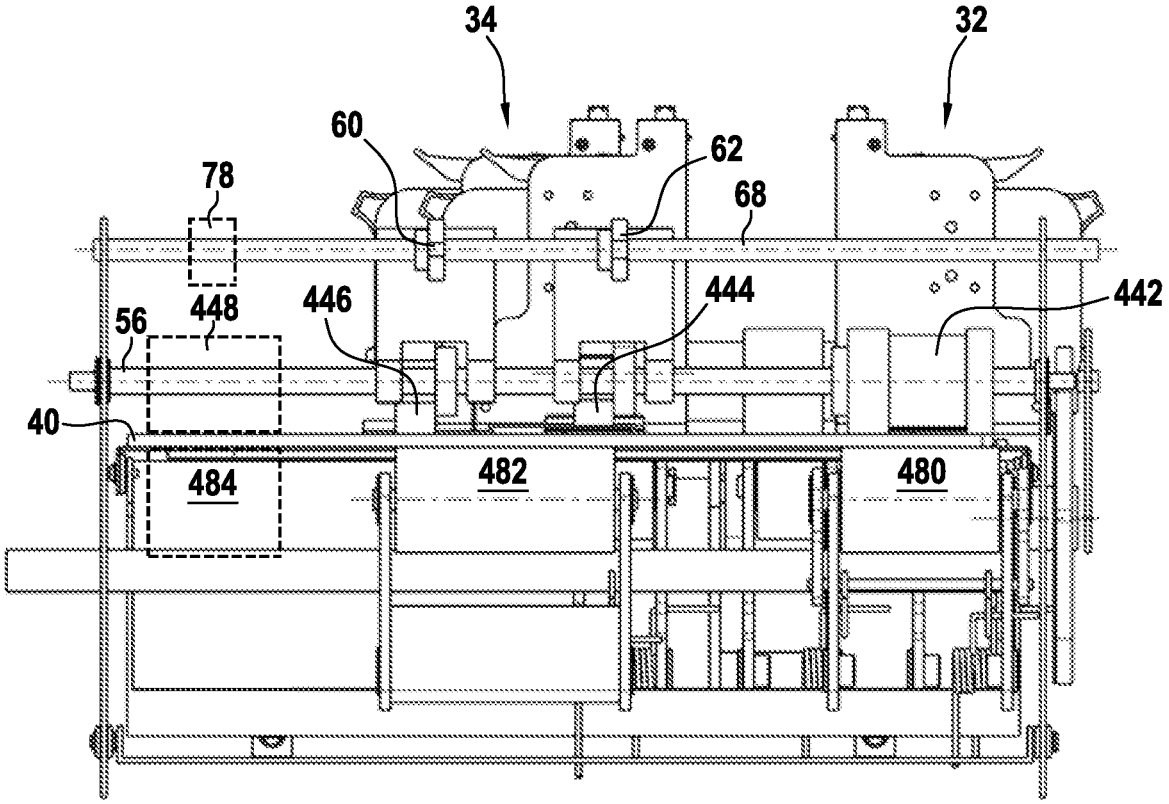
FIG. 8 is a right view of the envelope printer according to the invention.

FIG. 8 is a right view of the envelope printer according to the invention.

The second print module 34 is represented at the same print position than in FIGS. 4 and 5. The second mobile upper drive roller 446 is in its lower position and cooperates with the lower pressing rollers to drive the envelope. The first mobile upper drive roller 444 is in its upper position in order to avoid contact with the envelope immediately after printing. Indeed, it can be seen that neither the first mobile upper drive roller 444, nor the print plate 50 will touch the printed area immediately after it has been printed.

In the preferred embodiment, the cams 60, 62 are opposite and rotate along the same horizontal axis 68 so that when one of the mobile upper drive rollers is in the upper position, the other one is in the lower position. This is to ensure that at least one of the mobile upper drive rollers will always be in the lower position, so that the envelope 40 is pressed against it by the lower pressing rollers 482 of the downstream group 48. In another embodiment, each mobile upper drive roller 444, 446 may be moved independently by separate cams or another appropriate moving mechanism.

Only two mobile upper driver rollers 444, 446 have been represented. In an alternative embodiment, the envelope printer 18 may be provided with a third mobile upper driver roller 448 further away from the reference wall 30. This might be required for heavy mailpieces thicker than one centimetre. In this case, a third cam 78 will be arranged around the common horizontal axis 68 in such a manner that at least two mobile upper drive rollers are in their lower position to drive the envelope 40 while the third one is in its upper position. In another alternative embodiment this third mobile upper driver roller 448 may also be replaced by a fixed upper drive roller located at a position corresponding to the bottom of the C4 envelope in portrait mode. In this last case however, it will not be possible to print at that position without smearing the envelope. Whenever such an additional mobile (or fixed) upper drive roller is used, the lower pressing rollers of the downstream group 48 are extended or complemented with other pressing rollers 484 to ensure that the envelope 40 is pressed against all respective upper roller groups.

Other embodiments of the invention are possible. For instance the second print module 34 has been represented for convenience as a combination of two 1" ink jet printheads but it may be a combination of four ½" ink jet printheads, and similarly the first print module 32 a combination of two ½" ink jet printheads. If only six lines of addresses need to be printed, the second print module 34 may also be a combination of three ½" ink jet printheads.

Instead of being moved by a rotating cam 60, 62 as illustrated, each of the mobile upper drive rollers 444, 446 may also be moved from the lower to the upper position by a linear cam or another suitable mechanism attached to the second print module 34 when this print module is positioned ahead of the mobile upper drive roller. In this case, the mobile upper drive roller shall be biased downward, for instance by means of a spring, with a force greater than the one of the lower pressing rollers of the downstream group, and abut at the level of the print plate forming the upper reference for the envelopes.

Although the invention has been described with envelope of the C-series according to ISO 269 terminology, the printer can handle envelopes of the B-series or DL sizes.

The invention claimed is:

1. A device for printing information at multiple predetermined positions of a flat object including a registration wall, a print module including print nozzles and a print plate and displaceable along an horizontal axis perpendicular to the registration wall, fixed upper drive members for moving the flat object in a direction of transport along the registration wall, the print plate and the fixed upper drive members together forming an upper reference in a vertical direction, and lower pressing members for pressing the flat object against said upper reference, characterized in that it further comprises at least one mobile upper drive member and in that, for avoiding contact with the flat object immediately after printing, said at least one mobile upper drive member is vertically mobile and configured to be moved from a lower to an upper position above said upper reference when said displaceable print module is positioned along said horizontal axis ahead of said at least one mobile upper drive member in the direction of transport.

2. The device according to claim 1, further comprising a fixed print module at a fixed location respective to the registration wall and cooperating with the fixed upper drive members and the lower pressing members for printing at a fixed position on the flat object while said flat object is moving in the direction of transport.

3. The device according to claim 2, wherein the fixed upper drive members comprise a group of fixed upper drive rollers located upstream the displaceable print module and when present the fixed print module in the direction of transport.

4. The device according to claim 2, wherein the fixed upper drive members comprise a group of fixed upper drive rollers located downstream the displaceable print module and when present the fixed print module in the direction of transport.

5. The device according to claim 2, comprising at least two mobile upper drive rollers which are driven by a common drive axis and drive belt.

6. The device according to claim 2, wherein the print modules comprise one, two, three or four inkjet printheads.

7. The device according to claim 1, wherein the fixed upper drive members comprise a group of fixed upper drive rollers located upstream the displaceable print module and when present the fixed print module in the direction of transport.

8. The device according to claim 7, wherein the print modules comprise one, two, three or four inkjet printheads.

9. The device according to claim 1, wherein the fixed upper drive members comprise a group of fixed upper drive rollers located downstream the displaceable print module and when present the fixed print module in the direction of transport.

10. The device according to claim 1, wherein the lower pressing members comprise lower pressing rollers cooperating with the fixed and mobile upper drive rollers and a pressing plate perpendicular to the reference wall and traversing the device for pressing the flat object against the printing plate.

11. The device according to claim 1, comprising at least two mobile upper drive rollers which are driven by a common drive axis and drive belt.

12. The device according to claim 11, wherein, the common drive axis also drives the fixed upper drive rollers located downstream the displaceable print module and when present the fixed print module in the direction of transport.

13. The device according to claim 11, further comprising at least two cams acting against spring biased levers for moving the at least two mobile upper drive rollers between the lower and the upper position.

14. The device according to claim 13, wherein the first and second cams are opposite and rotate along a same horizontal axis so that when one of the at least two mobile upper drive rollers is in the upper position, the other one is in the lower position.

15. The device according to claim 11, wherein the mobile upper drive rollers can be moved independently from each other between the lower and the upper position.

16. The device according to claim 15, wherein a mobile upper drive roller is moved from the lower to the upper position by a linear cam attached to the displaceable print module when said displaceable print module is positioned along the horizontal axis ahead of said mobile upper drive roller in the direction of transport.

17. The device according to claim 13, wherein the at least one mobile upper drive member comprises three mobile upper drive rollers and three cams configured around a same horizontal axis in such a manner that two of the three mobile upper drive rollers are in the lower position while the third one is in the upper position.

18. The device according to claim 1, wherein the print modules comprise one, two, three or four inkjet printheads.

19. The device according to claim 18, further comprising a spitting reservoir and wherein the pressing plate comprises elongated slots through which ink of the inkjet printheads can be jetted in the spitting reservoir.

20. The device according to claim 1 wherein the flat object is an envelope of the C-series, the B-series or DL sizes according to ISO 269 terminology.

* * * * *